United States Patent [19]

Sato et al.

[11] 4,335,574

[45] Jun. 22, 1982

[54] CARBON PARTICLES REMOVING DEVICE

[75] Inventors: Susumu Sato, Okazaki; Yukihisa Takeuchi, Aichi; Masahiro Tomita, Anjo, all of Japan

[73] Assignee: Nippon Soken, Inc., Nishio, Japan

[21] Appl. No.: 223,723

[22] Filed: Jan. 9, 1981

[30] Foreign Application Priority Data

Feb. 15, 1980 [JP] Japan ..... 55-17977

[51] Int. Cl.[3] ..... F01N 3/02

[52] U.S. Cl. ..... 60/311; 55/212; 55/312; 55/283; 55/466; 55/527; 55/213; 55/DIG. 30; 60/295; 60/303

[58] Field of Search ..... 55/210, DIG. 30, 283, 55/466, 312, 212, 213, 523, 525, 526, 527, 498; 60/285, 286, 287, 295, 311, 303

[56] References Cited

U.S. PATENT DOCUMENTS 3,937,015 2/1976 Akado et al. ..... 55/523
4,211,075 7/1980 Ludecke et al. ..... 60/311
4,217,757 8/1980 Texaro ..... 55/DIG. 10
4,281,512 8/1981 Mills ..... 55/213

FOREIGN PATENT DOCUMENTS 2519609 11/1976 Fed. Rep. of Germany ..... 60/311
2655932 6/1978 Fed. Rep. of Germany ..... 55/213
2013103 8/1979 United Kingdom ..... 60/311

*Primary Examiner*—Bernard Nozick
*Attorney, Agent, or Firm*—Cushman, Darby & Cushman

[57] ABSTRACT

A device for removing fine carbon particles from exhaust gas emitted by automobile diesel engines or the like thereby to clean the exhaust gas. The device incorporates a filter for collecting fine carbon particles suspended by the exhaust gas. After a predetermined amount of fine carbon particles is accumulated on the filter, the carbon particles are burnt to regenerate the filter. The detection of amount of carbon particles accumulated on the filter is made through the detection of the fuel consumption of the engine or the differential pressure across the filter.

2 Claims, 3 Drawing Figures

CARBON PARTICLES REMOVING DEVICE

BACKGROUND OF THE INVENTION

1. Filed of the Invention

The present invention relates to a device for removing fine particles consisting mainly of carbon from exhaust gas emitted by automobile diesel engines or the like.

2. Description of the Prior Art

Hitherto, there has been proposed such an exhaust gas cleaning device of the kind described as having a filter or a cyclone disposed in the exhaust system and adapted to collect fine particles mainly consisting of carbon particles. It has been also proposed to dispose the carbon particles separating means in the vicinity of an exhaust manifold so that the collected carbon particles are burned by the heat of the exhaust gas.

The exhaust gas cleaning device employing a filter has a drawback that the filter is liable to be clogged with carbon particles, while the device incorporating a cyclone cannot completely collect the carbon particles because the latter has light small size. In the exhaust gas cleaning system in which the collected carbon particles are burnt by the heat possessed by the exhaust gas, it is essential that the exhaust gas temperature be as high as 600° C. In the normal running of automobiles around streets, however, there is almost no condition which would raise the exhaust gas temperature to such a high level as 600° C. or higher. Therefore, the collected carbon particles are burned incompletely, causing clogging of the filter.

SUMMARY OF THE INVENTION

It is, therefore, an object of the invention to provide a device for cleaning the exhaust gas by removing fine carbon particles effectively even during running of the automobile around the streets, thereby to obviate the above-described problems of the prior art.

To this end, according to the invention, there is provided a device for removing fine carbon particles from exhaust gas emitted by automobile engines or the like, characterized by comprising: first and second paths through which the exhaust gas from the engine is passed, a filter disposed in the first path and adapted to collect the fine carbon particles suspended in the exhaust gas, heating means disposed in the first path and adapted to burn the fine carbon particles collected by the filter, a valve disposed at the juncture of both paths and adapted to selectively open and close the paths and detecting means for detecting the amount of carbon particles collected by and accumulated on the filter, wherein the second path is opened by the valve and the heating means is activated when the amount of carbon particles collected by and accumulated on the filter has exceeded a predetermined amount.

The above and other objects, as well as advantageous features of the invention will become clear from the following description of the preferred embodiment of the invention taken in conjunction with the accompanying drawings.

DESCRIPTION OF THE PREFERRED EMBODIMENTS

Hereinafter, a carbon particle removing device of a first embodiment of the invention will be described with reference to FIGS. 1 and 2.

Figure 1:
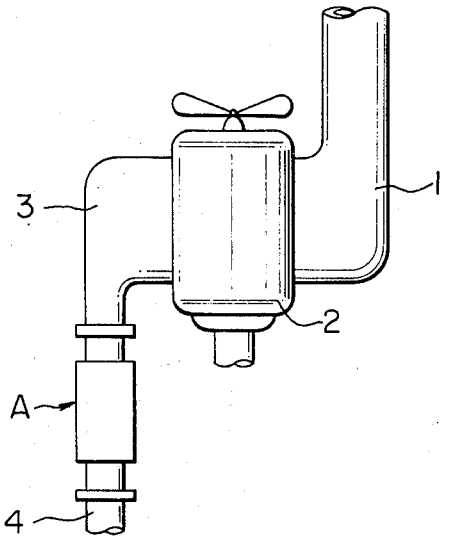
FIG. 1 is a schematic illustration showing how the device of the invention is mounted.

Referring first to FIG. 1, an internal combustion engine 2 (referred to simply as "engine," hereinafter) is shown having an intake manifold 1 and an exhaust manifold 3. An exhaust pipe 4 leads from the exhaust manifold 3. A carbon particle removing device of the invention, represented generally by A, is disposed downstream from the exhaust manifold 3, so as to burn the fine carbon particles collected from the exhaust gas emitted by the engine 2 thereby to clean the exhaust gas.

Figure 2:
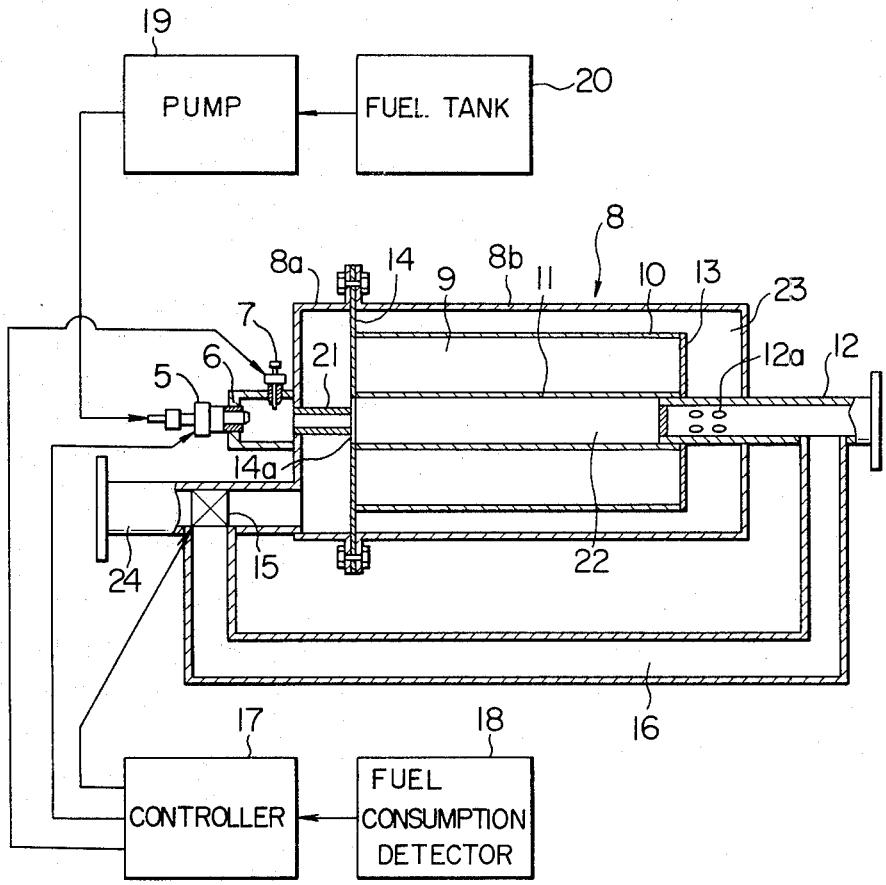
FIG. 2 is a sectional view of a carbon particles removing device constructed in accordance with an embodiment of the invention.

FIG. 2 shows the first embodiment of the invention. A pair of casing parts 8*a*, 8*b* are coupled to each other by means of flanges formed at their opposing ends to form a cylindrical casing 8. An exhaust gas inlet pipe 24 is connected to a peripheral portion of one side wall of the casing 8. The end of the inlet pipe 24 opens into the casing 8, while the other end of the same is connected to the downstream side end of the exhaust manifold 3 shown in FIG. 1. An exhaust gas outlet pipe 12 is connected to the central portion of the other side wall of the casing 8 so as to project into the casing 8. The other end of the exhaust gas outlet pipe 12 is connected to the exhaust gas pipe 4 shown in FIG. 1.

A multiplicity of small apertures 12*a* is formed in the wall of the portion of the pipe 12 in the casing 8. A holder 6 carrying a small-sized burner 5 and a glow plug 7 is secured to the casing member 8*a*. To the juncture between the casing parts 8*a* and 8*b*, is provided a partition plate 14 which divides the space in the casing 8 into two sections. The partition plate 14 is provided with a central opening 14*a* which coaxially opposes to the exhaust gas outlet pipe 12 at the center of the casing 8. Also, the casing part 8*a* has a guide 21 attached thereto and adapted to guide the flame on the burner 5 to the central opening 14*a*. At the center of the casing 8, cylinders 10, 11 made of stainless steel punched metal are arranged coaxially with the casing 8. The aforementioned partition plate 14 and the end plate 13 are arranged at both ends of the cylinders 10, 11. The annular space between the cylinders 10 and 11 is filled with a steel wool filter 9.

A bypass pipe 16 is shown having both ends connected to the exhaust gas inlet pipe 24 and exhaust gas outlet pipe 12, respectively. A valve for switching the path of flow of exhaust gas is disposed at the juncture between the bypass pipe 16 and the exhaust gas inlet pipe 24. More specifically, the arrangement is such that, when the valve 15 is opened, the exhaust gas flows through a first path constituted by the exhaust gas inlet pipe 24, space 22 formed in the pipe 11, filter 9, space 23 formed between the inner peripheral surface of the casing 8 and the pipe 10 and the exhaust gas outlet pipe 12. To the contrary, when the valve 15 takes the closing position, the exhaust gas flows through a second path constituted by the exhaust gas inlet pipe 24, bypass passage 16 and the exhaust gas outlet pipe 12.

The operations of the burner 5, glow plug 7 and the valve 15 are under control of a controller 17 which operates in accordance with a signal delivered by a fuel consumption detector 18 which detects the amount of fuel consumed by the engine 2. A reference numeral 19 designates a fuel pump for delivering fuel to the small-sized burner 5. A reference numeral 20 designates a fuel tank for storing the fuel to be supplied to the burner 5. The amount of fine carbon particles is substantially proportional to the amount of fuel consumed. It is, therefore, possible to know the amount of carbon particles collected by and accumulated by the filter.

In operation, the exhaust gas suspending the fine carbon particles is introduced into the device of the invention through the exhaust manifold 3 and the exhaust gas inlet pipe 24. Normally, the exhaust gas flows along the first path so that the fine carbon particles are collected by and accumulated on the filter 9. When the amount of the fine carbon particles separated by the filter 9 has reached a predetermined one, the controller 17 operates to actuate the valve 15 so that the exhaust gas starts to flow through the bypass pipe 16. Simultaneously with the switching of the valve 15, fire is set on the small-sized burner 5 by the glow plug 7 to produce heat by which the fine carbon particles accumulated on the filter 9 are burned. The exhaust gas is thus filtered of carbon particles and cleaned. After the completion of the burning, the exhaust gas starts to flow along the first path as the valve 15 is returned to the normal position.

According to the invention, as has been described, the fine carbon particles are burned completely even when the exhaust gas temperature has not reached a temperature which causes a natural burning of the carbon particles. This temperature has been experimentarily confirmed to be about 600° C. Therefore, the clogging of the filter 9 is avoided and the exhaust gas cleaning device can function for a long period of time. In addition, the use of the small-sized burner permits the time required for the burning of the carbon particles to be shortened, so that it is not necessary to provide a filter in the bypass pipe 16. This leads to an advantage of reduced installation space and weight of the exhaust gas cleaning device.

Figure 3:
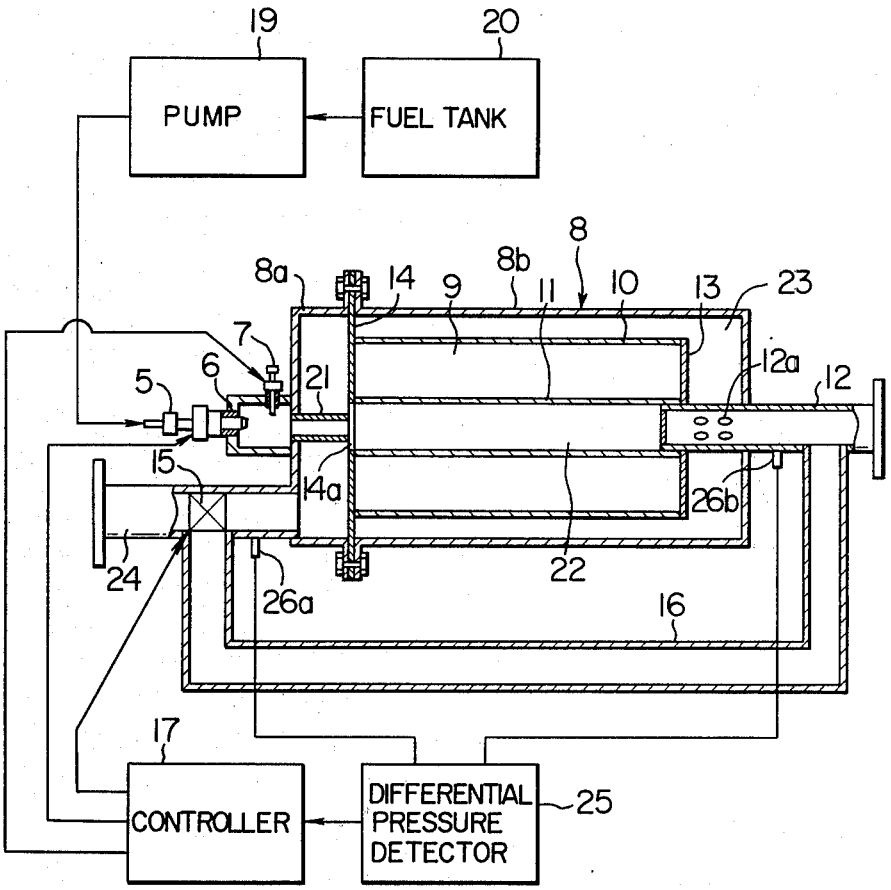
FIG. 3 is a sectional view of a carbon particles removing device constructed in accordance with another embodiment of the invention.

FIG. 3 shows a second embodiment of the invention having different means for detecting the amount of collected carbon particles from that of the first embodiment. Namely, in this second embodiment, pressure pick up ports 26*a*, 26*b* opening to the exhaust gas inlet pipe 24 and exhaust gas outlet pipe 12 are connected to the differential pressure detector 25 so that the amount of carbon particles accumulated on the filter 9 is detected by the differential pressure detector 25 as the pressure differential across the filter 9. As the pressure differential across the filter 9 reaches a predetermined level, the controller 17 is operated in the same manner as the first embodiment to actuate the valve 15 to permit the exhaust gas to flow through the bypass pipe 16 while starting the burner 5.

In this embodiment, the timing of burning is determined by the differential pressure across the filter 9, so that the burning is effected at each time the predetermined differential pressure is reached. Therefore, the small-sized burner 5 can be eliminated if the exhaust gas temperature is maintained within a range which would cause a natural burning of the carbon particles, to promise a fuel economy.

As will be clearly understood from the foregoing description, according to the invention, it is possible to completely burn the carbon particles collected by and accumulated on the filter in quite a short period of time and with reduced fuel consumption because the exhaust gas is made to flow through the bypass pipe during burning of the carbon particles. In addition, since the time required for the removal of the carbon particles is short, only one cleaning device is enough, thus permitting saving of installation space and reduction of weight of the exhaust gas cleaning system as a whole.

What is claimed is:

1. A device for removing fine carbon particles from exhaust gas emitted by an internal combustion engine, comprising:

a means providing a first path and a second path through which said exhaust gas may be alternately made to flow, said paths having a juncture;

a filter disposed in said first path and adapted to collect fine carbon particles suspended in said exhaust gas;

no filter of the kind and character of said filter being disposed in said second path;

a heating means disposed in said first path and adapted to burn said fine carbon particles collected by and accumulated on said filter;

a valve disposed at said juncture of said first and second paths and adapted to selectively open and close said first and second paths;

means for indirectly detecting the amount of said fine carbon particles collected by and accumulated on said filter by detecting the amount of fuel consumed by the engine;

and means for controlling the valve and the heating means together so that when the amount of said fine carbon particles collected by and accumulated on said filter has reached a predetermined amount, said valve is actuated temporarily to open said second path while said heating means is temporarily activated to burn said fine carbon particles;

said heating means including a small-sized burner attached to a holder such that a flame thereon is introduced into the inner cylinder of said filter, a glow plug for igniting the burner, a fuel tank adapted to supply fuel to the burner and a fuel pump arranged for pumping fuel from the fuel tank to the burner.

2. A device as claimed in claim 1, wherein said filter is composed of two coaxially related cylinders made of hole-punched stainless steel and being arranged so as to have an annular space between them, one axial end of the filter being open at the inner cylinder, the annular space between two cylinders being filled with a steel wool filter element.

* * * * *